US005333752A

United States Patent [19]

Harding, Jr.

[11] Patent Number: 5,333,752

[45] Date of Patent: Aug. 2, 1994

[54] STORAGE CONTAINER UNIT FOR HAZARDOUS LIQUIDS

[75] Inventor: Robert A. Harding, Jr., Clarkston, Mich.

[73] Assignee: Clawson Tank Company, Clarkston, Mich.

[21] Appl. No.: 19,106

[22] Filed: Feb. 18, 1993

[51] Int. Cl.[5] ..... B65D 90/24

[52] U.S. Cl. ..... 220/565; 220/571; 220/469; 220/608; 137/592; 137/565

[58] Field of Search ..... 220/565, 571, 469, 608, 220/408, 403, 401, 367; 137/592, 558, 565, 587

[56] References Cited

U.S. PATENT DOCUMENTS

| | | | |
|---|---|---|---|
| 1,520,230 | 12/1924 | Flath . | |
| 1,544,024 | 6/1925 | Moeller et al. | 137/592 |
| 1,970,940 | 8/1934 | Laube . | |
| 2,777,295 | 1/1957 | Bliss et al. . | |
| 3,125,388 | 3/1964 | Costantini et al. . | |
| 3,338,010 | 8/1967 | Waugh . | |
| 3,352,443 | 11/1967 | Sattelberg et al. . | |
| 3,383,004 | 5/1968 | Closner | 220/565 |
| 3,473,689 | 10/1969 | Hutter . | |
| 3,930,590 | 1/1976 | Ebbrell . | |
| 4,425,743 | 1/1984 | Bartur . | |
| 4,519,415 | 5/1985 | Carn . | |
| 4,533,062 | 8/1985 | Krautkramer | 220/367 |
| 4,584,802 | 4/1986 | Casselman et al. | 220/565 |
| 4,651,894 | 3/1987 | Ebert | 220/445 |
| 4,697,618 | 10/1987 | Youtt et al. | 137/587 |
| 4,714,170 | 12/1987 | Scott . | |
| 4,840,283 | 6/1989 | Lillywhite et al. | 220/469 |
| 4,934,553 | 6/1990 | McCarthy | 220/469 |
| 4,960,222 | 10/1990 | Fields, III . | |
| 4,976,912 | 12/1990 | Madle et al. . | |
| 5,033,638 | 7/1991 | Cruver et al. . | |
| 5,060,815 | 10/1991 | Wendling et al. | 220/401 |
| 5,161,690 | 11/1992 | Foshaug | 220/DIG. 6 |
| 5,201,435 | 3/1993 | Harding et al. . | |

*Primary Examiner*—S. Castellano

*Attorney, Agent, or Firm*—Barnes, Kisselle, Raisch, Choate, Whittemore & Hulbert

[57] ABSTRACT

A storage container unit comprises an inner tank for containing a hazardous liquid disposed within an outer tank. The side wall of the inner tank is spaced radially inwardly of the side wall of the outer tank to provide an annular air chamber. The top wall of the inner tank has a radially outwardly extending annular lip which overlaps an annular flange on the upper edge of the said wall of the outer tank to close the air chamber. The outer tank and air chamber provide a secondary dike against the escape of hazardous liquid, and also prevents accidental contamination of the annular space.

1 Claim, 1 Drawing Sheet

STORAGE CONTAINER UNIT FOR HAZARDOUS LIQUIDS

This invention relates generally to the storage of hazardous liquids and refers more particularly to a liquid container unit having a primary tank within a protective secondary tank.

BACKGROUND AND SUMMARY

Environmental considerations have led to the development of a container unit providing improved containment of hazardous liquids. In an indoor environment, where small capacity storage is needed, adequate containment is essential for personal safety. This invention provides secondary containment of the primary tank and thus prevents release of the hazardous liquid to the environment.

In accordance with the present invention, the storage container unit comprises an inner tank for containing a hazardous liquid, disposed within an outer tank. The side wall of the inner tank is spaced inwardly from the side wall of the outer tank to provide an annular air chamber. The top wall of the inner tank has a radially outwardly extending annular lip which overlaps an annular flange on the upper edge of the side wall of the outer tank to close the air chamber. The outer tank and air chamber provide a secondary dike against the escape of hazardous liquid, and also prevents accidental contamination of the annual space.

Preferably, the base of the outer tank is shaped to provide channels in the underside to receive the fork of a lift truck, and ribs on the upper side for supporting the base of the inner tank above the base of the outer tank to extend the air chamber beneath the inner tank.

The top wall of the inner tank has a fill opening, and a removable cap for the fill opening preferably has a vent plug for blowing out in the event of excess pressure in the inner tank. The storage container unit may also include a liquid level indicator to indicate the level of liquid in the inner tank.

The inner tank also desirably has a pump and a suction line to a sump in the bottom of the inner tank for a more complete removable of the liquid in the tank.

It is an object of this invention to provide a storage container unit having the above features.

Another object is to provide a storage container unit which is composed of a relatively few simple parts, is rugged and durable in use, and is easy to manufacture and assemble.

Other objects, features and advantages of the invention will become more apparent as the follow description proceeds, especially when taken with the accompanying drawings.

DETAILED DESCRIPTION

Figure 1:
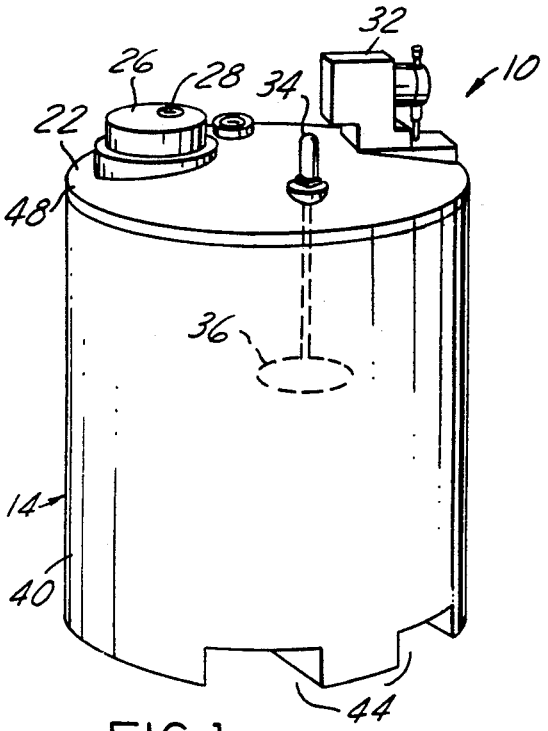
FIG. 1 is a perspective view of a storage container unit embodying the invention.
Figure 2:
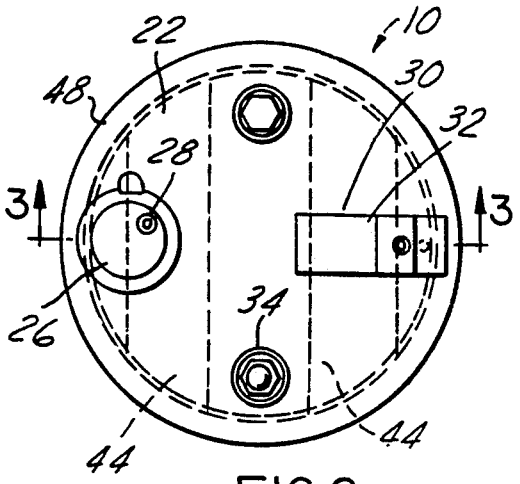
FIG. 2 is a top plan view thereof.
Figure 3:
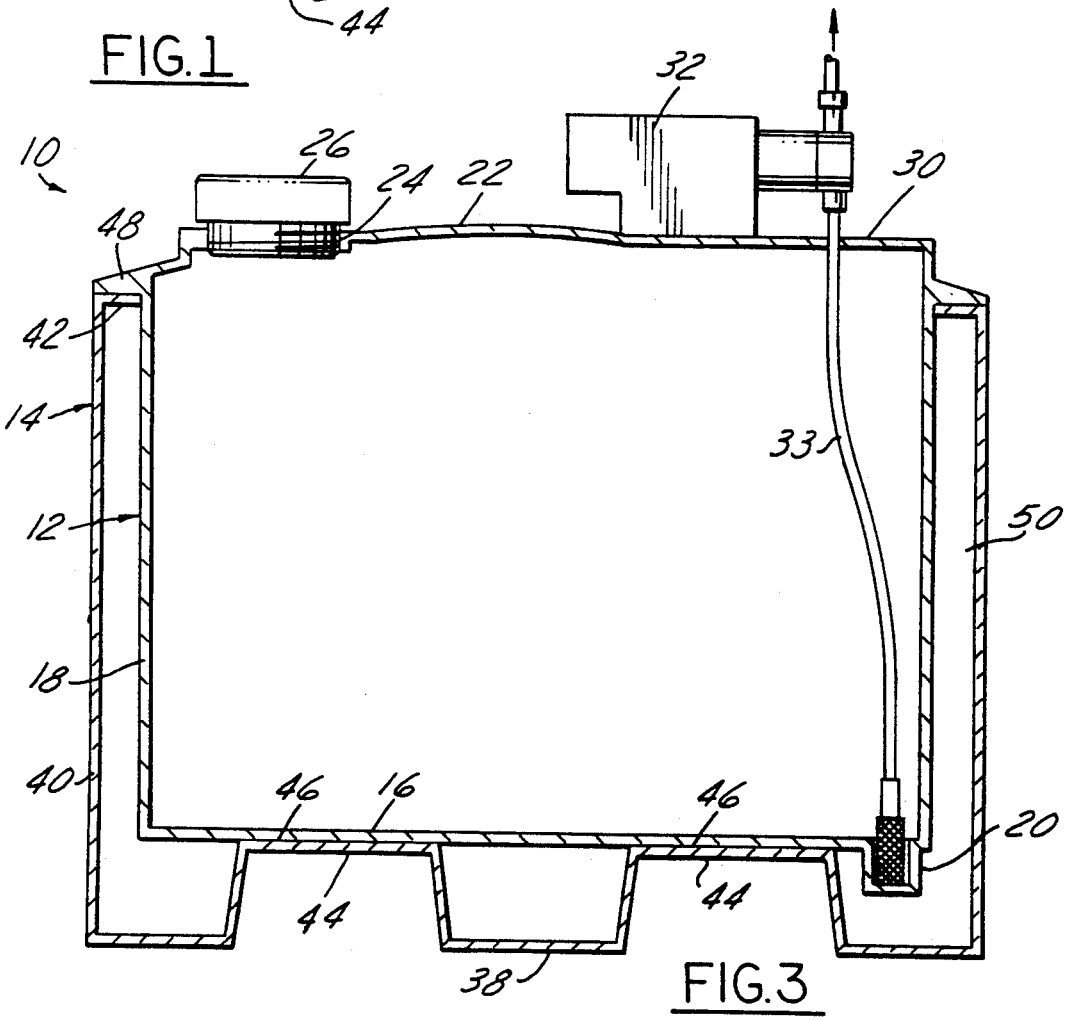
FIG. 3 is a sectional view taken on the line 3—3 in FIG. 2.

Referring now more particularly to the drawings, the storage container unit 10 comprises a primary or inner tank 12 and an outer tank 14 which houses the inner tank and provides secondary protection for the inner tank and its contents.

The inner tank 10 has a horizontal bottom wall 16 and an integral cylindrical side wall 18 extending vertically upwardly from the periphery of the bottom wall. Preferably the bottom wall is circular and the side wall is of uniform circular cross section throughout its vertical extent.

The bottom wall is preferably substantially flat except for a slight depression near one side providing a sump 20.

A generally horizontal top wall 22 is secured to the upper edge of the side wall throughout a full 360° to provide a closed container for liquid within the inner tank. The top wall has a fill opening 24 closed by a removable cap 26. The cap preferably has a vent plug 28 for blowing out in the event of excess pressure in the inner tank.

The top wall of the inner tank has a platform 30 on which may be mounted a suction pump 32 for drawing out liquid in the sump 20 at the bottom of the tank through a suction line 33. It is possible to withdraw almost the entire liquid contents of the tank because of this sump and pump construction.

The top wall also has a gauge 34 connected with a float 36 within the tank adapted to float on the surface of the liquid contents. The gauge indicates the level of liquid in the tank.

The outer tank has a bottom horizontal wall 38 and an integral cylindrical side wall 40 extending vertically upwardly from the periphery of the bottom wall. Preferably the bottom wall is circular and the side wall is of uniform circular cross section throughout its vertical extent. The side wall has a horizontal annual flange 42 extending radially inwardly from its upper edge.

The side wall of the inner tank is of slightly smaller outside diameter than the inner diameter of the flange 42 so that the inner tank may be inserted downwardly inside the outer tank in co-axial relation therewith.

The bottom wall 38 of the outer tank is shaped to provide laterally spaced, parallel channels 44 which extend completely across the bottom of the outer tank to receive the fork of a lift truck in order to move the container unit from place to place and also to provide ribs 46 within the outer tank for supporting the base of the inner tank in an elevated position and thus extend the air chamber beneath the inner tank.

The top wall 22 of the inner tank has a radially outwardly extending annular lip 48 which overlies and rests upon the annular flange 42 of the outer tank when the inner tank is fully installed therein. The bottom wall 16 of the inner tank is also supported upon the ribs 46 on the bottom wall 38 of the outer tank. Thus there is an annular air chamber 50 between the side walls of the two tanks which extends under the bottom of the inner tank. The air chamber is closed by the lip 48 of the top wall of the inner tank which overlaps and effectively seals against the flange 42 at the top of the outer tank. Lip 48 prevents accidental contamination of the air chamber, and the outer tank and air chamber provide a secondary dike against the escape of hazardous liquids.

The two tanks are formed of a material which is not incompatible with the liquid being stored. The stored liquid may, for example, be water treatment chemicals or a non-flammable liquid such as an anti-freeze. These tanks may be made of other materials for liquids not compatible with polyethylene, for example, steel or stainless steel.

The storage container unit of this invention can be of any size, but is intended primarily for small capacity storage. For example, units having a capacity of 35–165 gallons are contemplated.

What is claimed is:

1. An above ground storage container unit for hazardous liquids which comprises:

(a) an inner tank having a bottom wall and an annular side wall extending upwardly therefrom;

(b) an open top outer tank having a bottom wall and an annular side wall extending upwardly therefrom, said inner tank being disposed within said outer tank with said bottom wall of said inner tank adjacent said bottom wall of said outer tank and said side wall of said inner tank spaced radially inwardly from said side wall of said outer tank to provide an annular air chamber between said side walls, and (c) an enclosing top wall of said inner tank to contain hazardous liquids in said inner tank, said side wall of said outer tank having an annular, radially inwardly extending flange along its upper edge, said inner tank having a radially outwardly extending lip in overlying sealing contact with said flange of the side wall of said outer tank to close and prevent contamination of said air chamber, (d) said bottom wall of said outer tank being shaped to provide laterally spaced, downwardly opening channels and upwardly opening channels between said downwardly opening channels, said downwardly opening channels being adapted to receive the fork of a fork lift truck whereby said storage container unit can be moved, said downwardly opening channels each having a base, the bottom wall of said inner container being supported on the bases of said downwardly opening channels, said upwardly opening channels communicating with said annular air chamber to provide an enlarged air chamber, said outer tank and said enlarged air chamber providing a secondary dike against the escape of hazardous liquids, (e) said bottom wall of said inner tank having a sump extending downwardly into one of said upwardly opening channels, a suction line from said sump extending through the top wall of said inner tank, and a pump mounted on said top wall for withdrawing liquid through said suction line.

* * * * *